United States Patent [19]

Ito

[11] 3,971,287

[45] July 27, 1976

[54] DAMPER FOR STRING INSTRUMENT

[76] Inventor: Tetsuo Ito, 5-5-22, Shimo-Hoya, Hoya, Tokyo, Japan

[22] Filed: Sept. 9, 1974

[21] Appl. No.: 504,238

[30] Foreign Application Priority Data

Nov. 26, 1973 Japan ..... 48-135760[U]

[52] U.S. Cl. ..... 84/453; 84/267; 84/312; 84/318

[51] Int. Cl.[2] ..... G10D 3/00

[58] Field of Search ..... 84/273, 318, 310, 311, 84/319, 294, 267, 453, 465, 312; D56/1 R, 1 A

[56] References Cited

UNITED STATES PATENTS

| | | | |
|---|---|---|---|
| 536,634 | 4/1895 | Kyle | 84/310 UX |
| 583,102 | 5/1897 | Utt | 84/318 |
| 652,520 | 6/1900 | Pletcher | 84/318 |
| 1,772,725 | 8/1930 | Lewis | 84/310 |

FOREIGN PATENTS OR APPLICATIONS

| | | | |
|---|---|---|---|
| 23,097 | 10/1896 | United Kingdom | 84/310 |

*Primary Examiner*—John F. Gonzales
*Attorney, Agent, or Firm*—Robert E. Burns; Emmanuel J. Lobato; Bruce L. Adams

[57] ABSTRACT

A damper for a stringed instrument has an elastic foldable web provided with catch members positioned at the end portions thereof, a hinge portion positioned at the longitudinally central portion thereof and notches of substantially isosceles triangular shape disposed close to and outwardly from the hinge portion. On the inner surface of the foldable web a resilient spongy member is secured. When the foldable web is folded for holding the strings of a stringed instrument in between the upper and lower layers of the resilient spongy member and the catch members are fastened, the strings are compressed by the spongy member and the sounds produced from the strings may be lowered.

11 Claims, 3 Drawing Figures

DAMPER FOR STRING INSTRUMENT

BACKGROUND OF THE INVENTION

The present invention relates to a damper for a string instrument.

String instruments, such as guitars, ukeleles, mandolins, mandocellos and banjos, have been used for playing music from old times. Such a string instrument comprises a plurality of strings for vibrating to produce a sound of a desired pitch and tone when touched by a finger of a player, and a resonant body having a sound board provided with a sound hole for amplifying the sound produced from the strings.

Needless to say, the player of the string instrument must practice on his instrument over and over again with the aim to becoming a skilled musician. However, in this practical training, loud sounds are produced from these string instruments, which cause a nuisance to the neighbors. In order to relieve the neighbors of the nuisance caused by such loud sounds, the player shall endeavor not to produce loud sounds in his practical training. For this reason, a handy and yet practically serviceable damper for the aforementioned popular string instruments is highly desired. Until now, however, such a damper for the popular string instruments has not been commercially available.

SUMMARY OF THE INVENTION

It is, therefore, a primary object of this invention to provide a damper for string instruments which is handy and economical and can exert a strong effect for lowering the sounds produced from such string instruments.

Another object of this invention is to provide a damper for string instruments which is readily attached to and detached from such string instruments.

A further object of this invention is to provide a damper for the string instruments having a novel construction which facilitates manufacturing thereof.

According to this invention, there is provided a damper for the string instruments which comprises an elastic foldable web and a resilient spongy member secured to the inner surface of the foldable web. The elastic foldable web is provided with catch means positioned at the end portions thereof for fastening and damping the strings of the string instrument between the resilient spongy member, a hinge means positioned at the longitudinally central portion of the web for freely bending the web in an inward direction, and notched portions having sections of isosceles shape and disposed on the inner surface of the web close to and outer from the aforementioned hinge means. The notched portions provided at the both adjacent portions of the hinge means function to uniformly compress each string of the string instrument in cooperation with the resilient characteristic of the web as mentioned in detail in hereinbelow.

For a resilient member which is secured to the inner surface of the foldable web, it is unexpectedly found that a material having a continuous structure of small open-celled voids is preferred rather than a common acoustically absorptive material having closed-cellular voids. It is thus preferred as a resilient member of a damper according to this invention, a "spongy member" such as a moltprene, felt or an elastic synthetic rubber or plastics having open cells rather than a closed-cellular material such as a closed cellular rubber or a foamed thermoplastic or thermosetting resin having multiplicity of closed cells, e.g. closed-cellular polystyrene and ployurethane. In this instance, it should be appreciated that the terminology "resilient spongy member" as used herein means an elastic or resilient member having open-celled structure.

In a preferred embodiment of this invention, the elastic foldable web is composed of an integral strip of polypropylene and the hinge means is made up of a thin plane portion formed at the central portion of the polypropylene strip.

DRAWING

DESCRIPTION

According to this invention, there is provided a damper for string instrument such as guitar, ukelele, mandolin, mandocello and banjo, which damper is particularly convenient in that it is handy and readily attached to and detached from the string instruments and that it has a novel construction which facilitates manufacturing thereof.

The damper of the invention, in general, comprises an elastic foldable web composed of a synthetic resin such as polypropylene and provided with a catch means, a hinge means and notched portions provided at the both adjacent portions of the hinge means; and a resilient spongy member.

The elastic foldable web serves both as a support means for the resilient spongy member and as a compression means for compressing strings of the string instrument associated with the functions of the hinge means, the notched portions and the resilient spongy member when the damper is attached to the string instrument and the catch means is fastened for holding the strings in between the resilient spongy member. The web may be made up of an integral strip of an elastic thermoplastic synthetic resin such as polypropylene, but it can be made up of a composite material, for example, composed of a flexible, continuous and thin strip of high pressure process polyethylene or polyester film and more rigid and elastic fragments of thermoplastic or thermosetting resin integrally melt-welded to from a continuous flexible film. The most preferred material for the web is a polypropylene film having a sufficient thickness for providing the desired compression force.

In the practical embodiments of this invention, the web is a few cm in width and a few mm in thickness. The length of the web may be varied in accordance with the special kind of the string instrument to which the damper is attached.

In the most preferred embodiment of this invention, the hinge means is a thin plane portion of a polypropylene strip, but it may be any other means provided that notched portions are provided at the vicinity of the both end portions thereof.

According to an important aspect of the present invention, there is provided, on the inner surface of the web and at the both sides of the hinge means, notched portions having sections of substantially isosceles shape, by the function of which the web of the damper can be curved in a substantially ellipsoidal configuration thereby for uniformly compressing the strings when the damper is attached to a string instrument.

The resilient spongy member is composed of a material as hereinbefore defined and secured to the inner surface of the elastic foldable web at the inner surfaces thereof and can be mutually applied to the inner surfaces thereof when the foldable web is bent inwardly and the catch means is fastened.

PREFERRED EMBODIMENT

Figure 1:
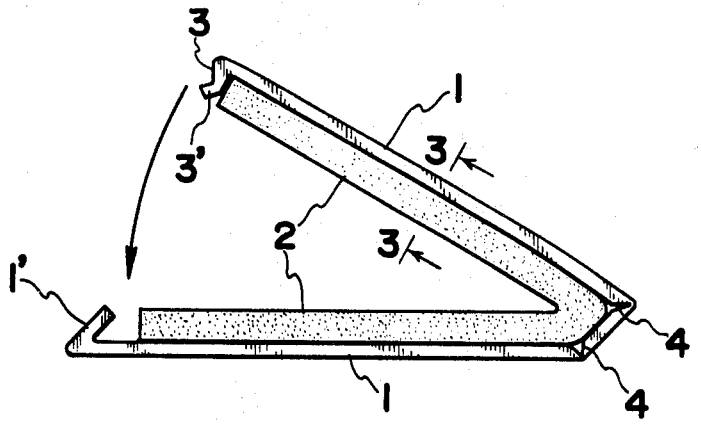
FIG. 1 is a sectional view of a preferred embodiment of the present invention in an open or relieved position.

A strip of a thermoplastic polypropylene having a thickness of 2 mm, a width of 3 cm and a length of 18.2 cm was prepared by cutting off from a polypropylene film. As shown in FIG. 1, on the inner surface of the thusly prepared web 1, notched portions 4 and 4 having the same configurations of substantially isosceles triangle shape were provided. At one end portion 1' of the strip 1, there was provided a clasp having a hooked edge bent in an acute angle as is illustrated in the drawing. At the other end portion 3 of the strip 1, there was provided a wedge having a sectional configuration of letter V for engaging with the hooked edge disposed at the end portion 1'. On the inner surface of the strip was secured a resilient member 2 made of a Moltprene and having an uniform thickness of 6 mm.

Figure 3:
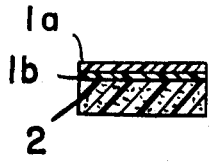
FIG. 3 is a cross section taken at the location indicated by the line 3—3 in FIG. 1 but showing a modification.

In a modification as illustrated by way of example in FIG. 3 the strip 1 is made up of a composite material comprising a thin strip 1*a* of high pressure process polyethylene and a more rigid strip 1*b* of thermosetting resin. The two strips are integrally melt-welded together to form a continuous unitary strip.

Figure 2:
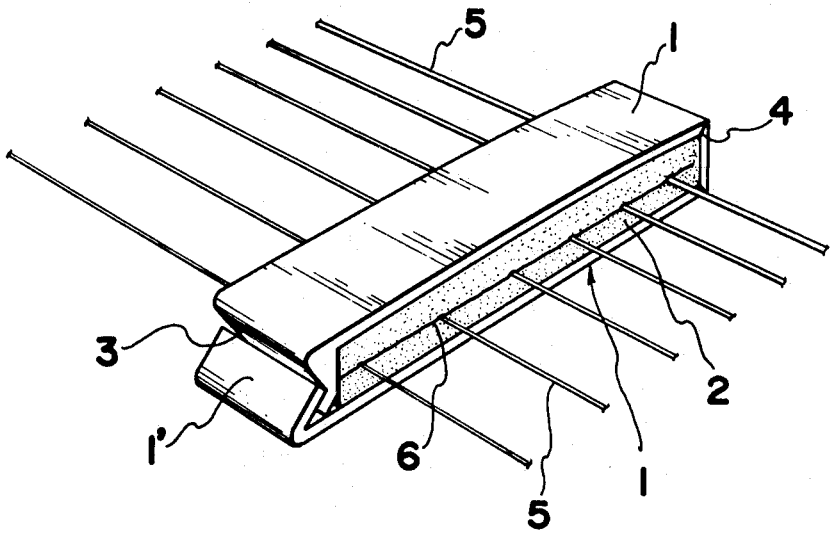
FIG. 2 is a perspective view of a damper shown in FIG. 1, wherein the damper is attached to a string instrument and fastened for compressing the strings thereof.

In the practical use of the damper, the strings 5 of the string instrument (not shown) are held in between the upper and lower layers of the resilient member 2, as shown in FIG. 2, and subsequently the engage means including a hooked edge and a wedge portions 1' and 3 are fastened. In the closed and compressed position, the strings extend substantially perpendicularly to the longitudinal edge of the damper. The outer surfaces of the strip 1 is curved in a substantially ellipsoidal configuration under the influences of the elastic characteristic of itself and the notched portions 4. The contacting surface area 6 between the upper and lower layers of the resilient member 2 is formed, and thus the strings held therebetween are compressed and thereby the vibration of the strings are suppressed and the sounds produced from the strings are lowered.

What is claimed is

1. A damper for a stringed instrument comprising a clamp formed of an integral elongate strip of plastic material comprising two leg portions of approximately equal length, a short intermediate connecting portion and transversely notched portions joining opposite ends of said connecting portion with one end of each of said leg portions in hinge lines, the other ends of said leg portions being free, and catch means at said free ends of said leg portions for releasably securing said free ends together, said legs being movable by flexing of said strip at said hinge lines between a closed position in which said catch means is engaged and said legs are approximately parallel to one another and an open position in which said catch means is disengaged and said legs are disposed angularly to one another and a strip of plastic sponge material on the inner faces of said legs, said plastic sponge material being of a thickness equal to approximately half the distance between said legs when in closed position so as to engage the strings of a stringed instrument disposed between said legs and thereby damp said strings.

2. A damper according to claim 1, in which each of said notched portions has a transversely extending notch of isosceles cross section in the inner face of the strip.

3. A damper according to claim 1, in which said plastic material of said strip is an elastic thermoplastic synthetic resin.

4. A damper according to claim 3, in which said plastic material of said strip is polypropylene.

5. A damper according to claim 3, in which said plastic material of said strip is polyester.

6. A damper according to claim 1, in which said strip is formed of a composite material comprising layers bonded together, one layer being a continuous flexible film of plastic material and another layer comprising more rigid segments of synthetic resin material.

7. A damper according to claim 6, in which said flexible film is formed of plastic material selected from the group consisting of polyethylene and polyester.

8. A damper according to claim 1, in which said plastic sponge material has a continuous structure of small open-cell voids.

9. A damper according to claim 1, in which said catch means comprises integral end portions of said legs shaped to engage one another.

10. A damper according to claim 6, in which said end portion of one leg is bent angularly to form a hook and said end portion of the other leg is reversely bent to form a catch engageable with said hook.

11. A damper according to claim 1, in which said notched portions have notches of isosceles triangle shape on the inner surface of said strip.

* * * * *